US009169795B2

(12) United States Patent
Jammoussi et al.

(10) Patent No.: US 9,169,795 B2
(45) Date of Patent: Oct. 27, 2015

(54) EXHAUST GAS SENSOR DIAGNOSIS AND CONTROLS ADAPTATION

(71) Applicant: Ford Global Technologies, LLC, Dearborn, MI (US)

(72) Inventors: Hassene Jammoussi, Dearborn, MI (US); Imad Hassan Makki, Dearborn Heights, MI (US); Dimitar Petrov Filev, Novi, MI (US); Adam Nathan Banker, Plymouth, MI (US); Michael James Uhrich, West Bloomfield, MI (US); Michael Casedy, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 326 days.

(21) Appl. No.: 13/779,349

(22) Filed: Feb. 27, 2013

(65) Prior Publication Data

US 2014/0238368 A1 Aug. 28, 2014

(51) Int. Cl.

| | |
|---|---|
| ***F02D 41/30*** | (2006.01) |
| *F02D 41/14* | (2006.01) |
| *F02D 41/24* | (2006.01) |

(52) U.S. Cl.

CPC ..... *F02D 41/30* (2013.01); *F02D 41/1495* (2013.01); *F02D 41/2454* (2013.01); *F02D 41/146* (2013.01); *F02D 41/1453* (2013.01); *F02D 41/1454* (2013.01); *F02D 41/1456* (2013.01); *F02D 41/1459* (2013.01); *F02D 41/2438* (2013.01); *F02D 41/2474* (2013.01); *F02D 2041/143* (2013.01); *F02D 2041/1409* (2013.01); *F02D 2041/1422* (2013.01); *F02D 2041/1431* (2013.01); *F02D 2041/1432* (2013.01)

(58) Field of Classification Search

CPC . F02D 41/30; F02D 41/1495; F02D 41/2454; F02D 41/1453; F02D 41/1454; F02D 41/1456; F02D 41/1459; F02D 41/146; F02D 41/2438; F02D 41/2474; F02D 2041/1409; F02D 2041/1422; F02D 2041/143; F02D 2041/1431; F02D 2041/1432; F02D 41/1481–41/1484; F02D 41/1486

USPC ..... 123/672, 478, 674, 693, 690, 696; 701/101, 103, 104; 73/114.72, 114.73; 60/276, 277, 285

See application file for complete search history.

(56) References Cited

U.S. PATENT DOCUMENTS

| | | | | |
|---|---|---|---|---|
| 7,006,909 | B1 * | 2/2006 | May | 701/102 |
| 7,040,307 | B2 * | 5/2006 | Nagashima et al. | 123/688 |
| 7,484,504 | B2 * | 2/2009 | Kato et al. | 123/672 |

(Continued)

FOREIGN PATENT DOCUMENTS

CN 101509433 A * 8/2009

*Primary Examiner* — Stephen K Cronin
*Assistant Examiner* — Xiao Mo
(74) *Attorney, Agent, or Firm* — Julia Voutyras; Alleman Hall McCoy Russell & Tuttle LLP

(57) ABSTRACT

Methods and systems are provided for adjusting an anticipatory controller of an exhaust gas sensor coupled in an engine exhaust. In one embodiment, the method comprises adjusting fuel injection responsive to exhaust oxygen feedback from the anticipatory controller of the exhaust gas sensor and adjusting one or more parameters of the anticipatory controller responsive to a type of oxygen sensor degradation. In this way, the anticipatory controller may be adapted based on the type and magnitude of the degradation behavior to increase performance of the air-fuel control system.

20 Claims, 6 Drawing Sheets

(56) References Cited

U.S. PATENT DOCUMENTS

| | | | | |
|---|---|---|---|---|
| 8,145,409 | B2 * | 3/2012 | Kerns et al. | 701/109 |
| 2002/0148447 | A1 * | 10/2002 | Weisman, II | 123/480 |
| 2007/0227123 | A1 * | 10/2007 | Iida et al. | 60/277 |
| 2009/0112441 | A1 * | 4/2009 | Perschl et al. | 701/103 |
| 2011/0132341 | A1 * | 6/2011 | Magner et al. | 123/703 |
| 2013/0180509 | A1 | 7/2013 | Makki et al. | |
| 2013/0180510 | A1 | 7/2013 | Makki et al. | |
| 2013/0231844 | A1 | 9/2013 | Uhrich et al. | |

* cited by examiner

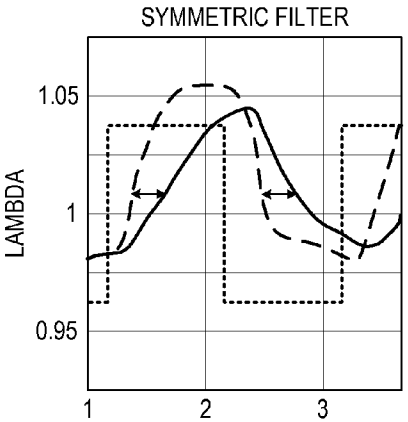
FIG. 2
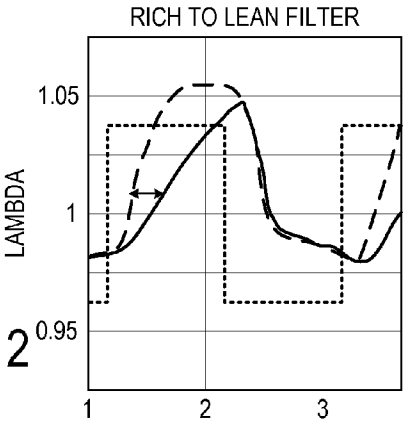
FIG. 3
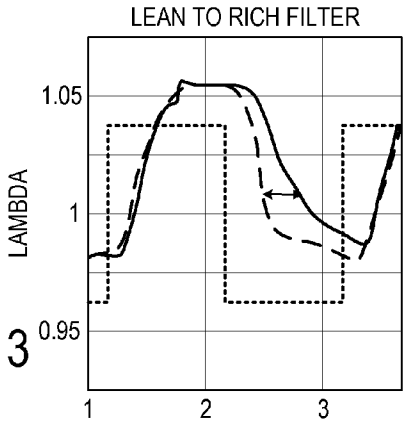
FIG. 4
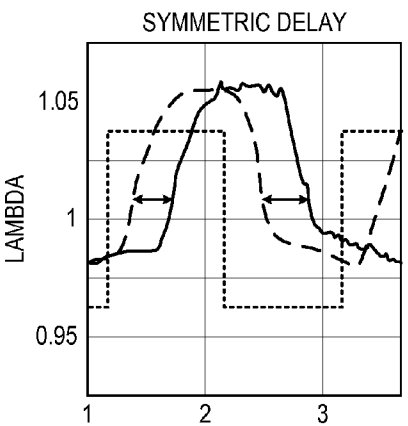
FIG. 5
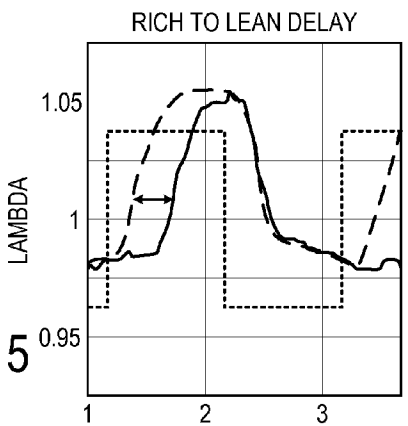
FIG. 6
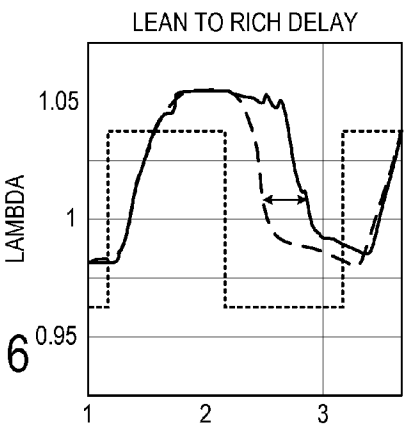
FIG. 7
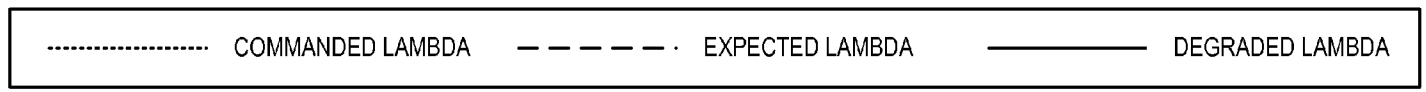

EXHAUST GAS SENSOR DIAGNOSIS AND CONTROLS ADAPTATION

BACKGROUND/SUMMARY

An exhaust gas sensor having an anticipatory controller may be positioned in an exhaust system of a vehicle to detect an air-fuel ratio of exhaust gas exhausted from an internal combustion engine of the vehicle. The exhaust gas sensor readings may be used to control operation of the internal combustion engine to propel the vehicle.

Degradation of an exhaust gas sensor may cause engine control degradation that may result in increased emissions and/or reduced vehicle drivability. Accordingly, accurate determination of exhaust gas sensor degradation and subsequent adjustments to parameters of the anticipatory controller may reduce the likelihood of engine control based on readings from a degraded exhaust gas sensor. In particular, an exhaust gas sensor may exhibit six discrete types of degradation behavior. The degradation behavior types may be grouped into filter type degradation behaviors and delays type degradation behaviors. An exhaust gas sensor exhibiting filter type degradation behavior may have a degraded time constant of the sensor reading while an exhaust gas sensor exhibiting delay type degradation behavior may have a degraded time delay of the sensor reading. In response to sensor degradation, anticipatory controller parameters may be adjusted to increase accuracy of the readings of the degraded exhaust gas sensor.

Previous approaches to adjusting parameters of the anticipatory controller of an exhaust gas sensor, responsive to degraded behavior, include reducing anticipatory controller gains irrespective of the type and magnitude of sensor degradation. In one example, to maintain stability of the anticipatory controller system, controller gains may be reduced aggressively to reduce system instability. However, adjusting controller parameters in this way may result in reduced performance of the air fuel control system.

The inventors herein have recognized the above issues and identified an approach for adjusting one or more parameters of the anticipatory controller of the exhaust gas sensor responsive to a type of oxygen sensor degradation. The type of oxygen sensor degradation may include a filter degradation or a delay degradation. In one example, the filter degradation may be indicated by a degraded time constant being greater than an expected time constant and the delay degradation may be indicated by a degraded time delay being greater than an expected time delay. A magnitude of the sensor degradation may be determined from the degraded time constant and/or degraded time delay. Adjusting one or more parameters of the anticipatory controller may include adjusting a proportional gain, an integral gain, a controller time constant, and a controller time delay. The controller time constant and time delay may be utilized by a delay compensator of the anticipatory controller.

In one example, the parameters of the anticipatory controller may be adjusted by a first amount responsive to a delay degradation and the parameters of the anticipatory controller may be adjusted by a second, different, amount responsive to a filter degradation. Fuel injection of the engine may then be adjusted responsive to exhaust oxygen feedback from the anticipatory controller. The amount of adjusting the parameters may be further based on the magnitude of the degraded time constant and/or degraded time delay. As such, the anticipatory controller may be adapted based on the type and magnitude of the degradation behavior. In this way, performance of the air-fuel control system may be increased.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows a graph indicating a symmetric filter type degradation behavior of an exhaust gas sensor.

FIG. 3 shows a graph indicating an asymmetric rich-to-lean filter type degradation behavior of an exhaust gas sensor.

FIG. 4 shows a graph indicating an asymmetric lean-to-rich filter type degradation behavior of an exhaust gas sensor.

FIG. 5 show a graph indicating a symmetric delay type degradation behavior of an exhaust gas sensor.

FIG. 6 shows a graph indicating an asymmetric rich-to-lean delay type degradation behavior of an exhaust gas sensor.

FIG. 7 shows a graph indicating an asymmetric lean-to-rich delay type degradation behavior of an exhaust gas sensor.

DETAILED DESCRIPTION

Figure 1:
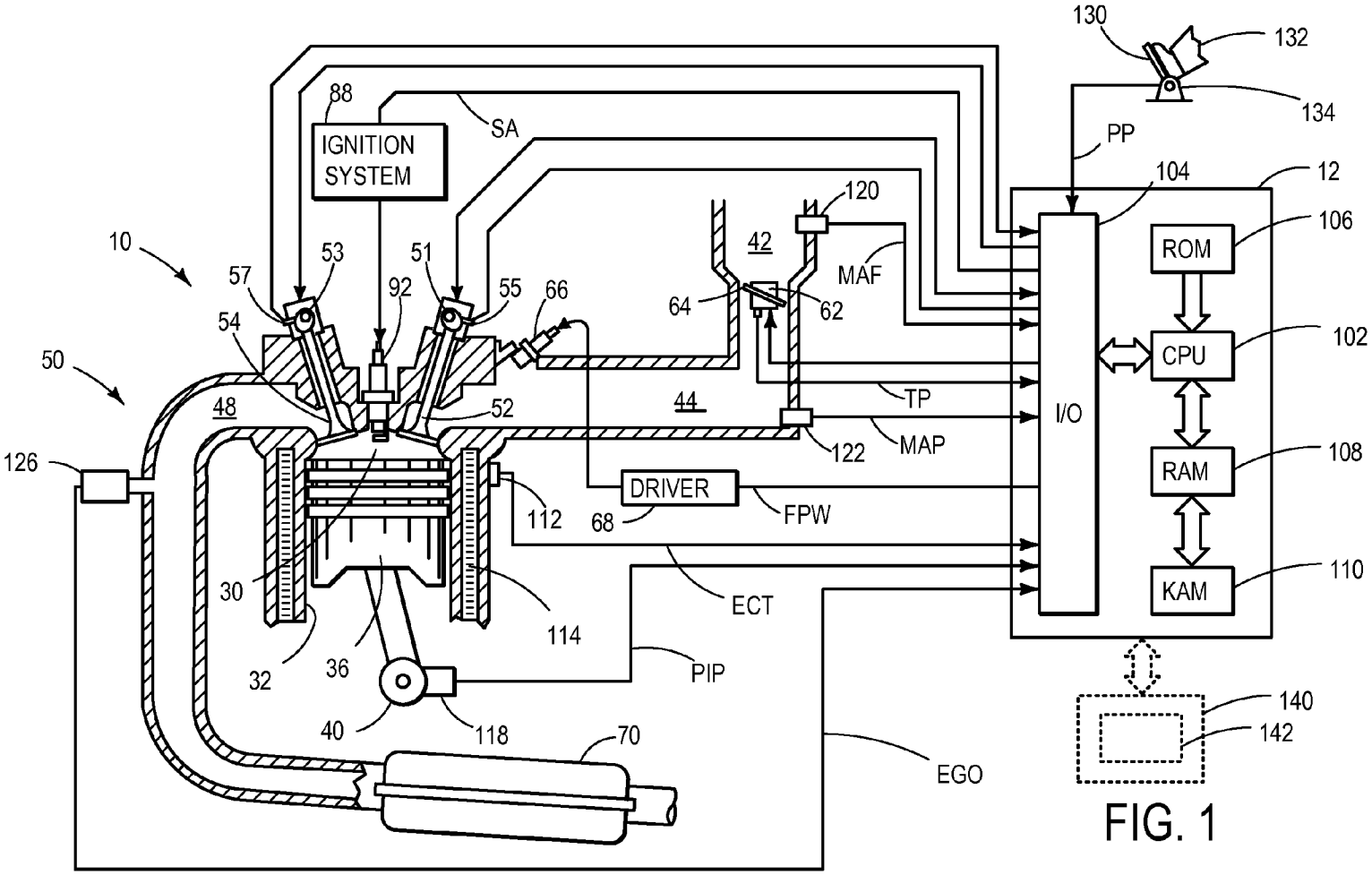
FIG. 1 shows a schematic diagram of an embodiment of a propulsion system of a vehicle including an exhaust gas sensor.
Figure 9:
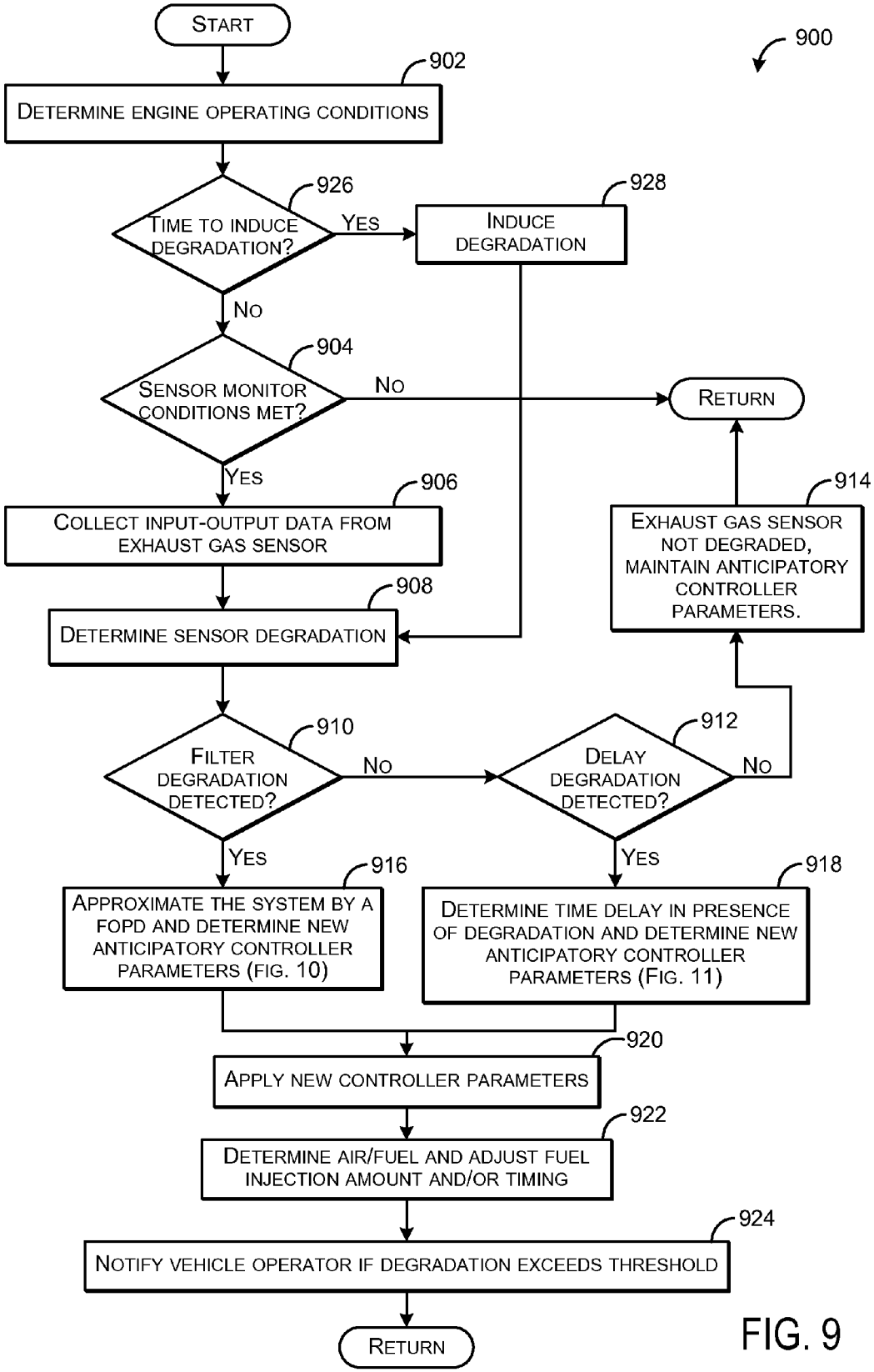
FIG. 9 is a flow chart illustrating a method for adjusting parameters of an anticipatory controller of an exhaust gas sensor, based on a type and magnitude of degradation.
Figure 10:
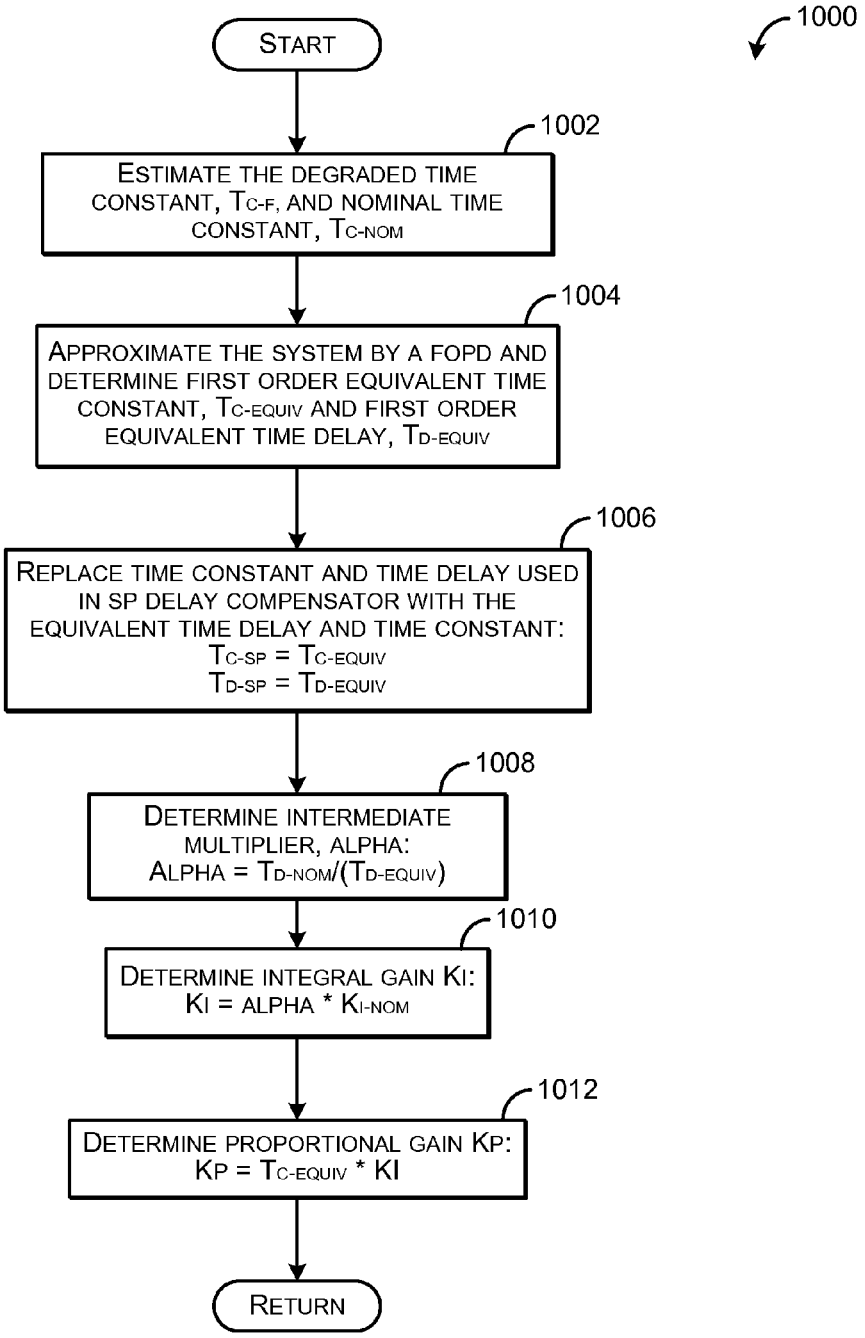
FIG. 10 is a flow chart illustrating a method for determining adjusted parameters of the anticipatory controller of the exhaust gas sensor based on filter degradation behavior.
Figure 11:
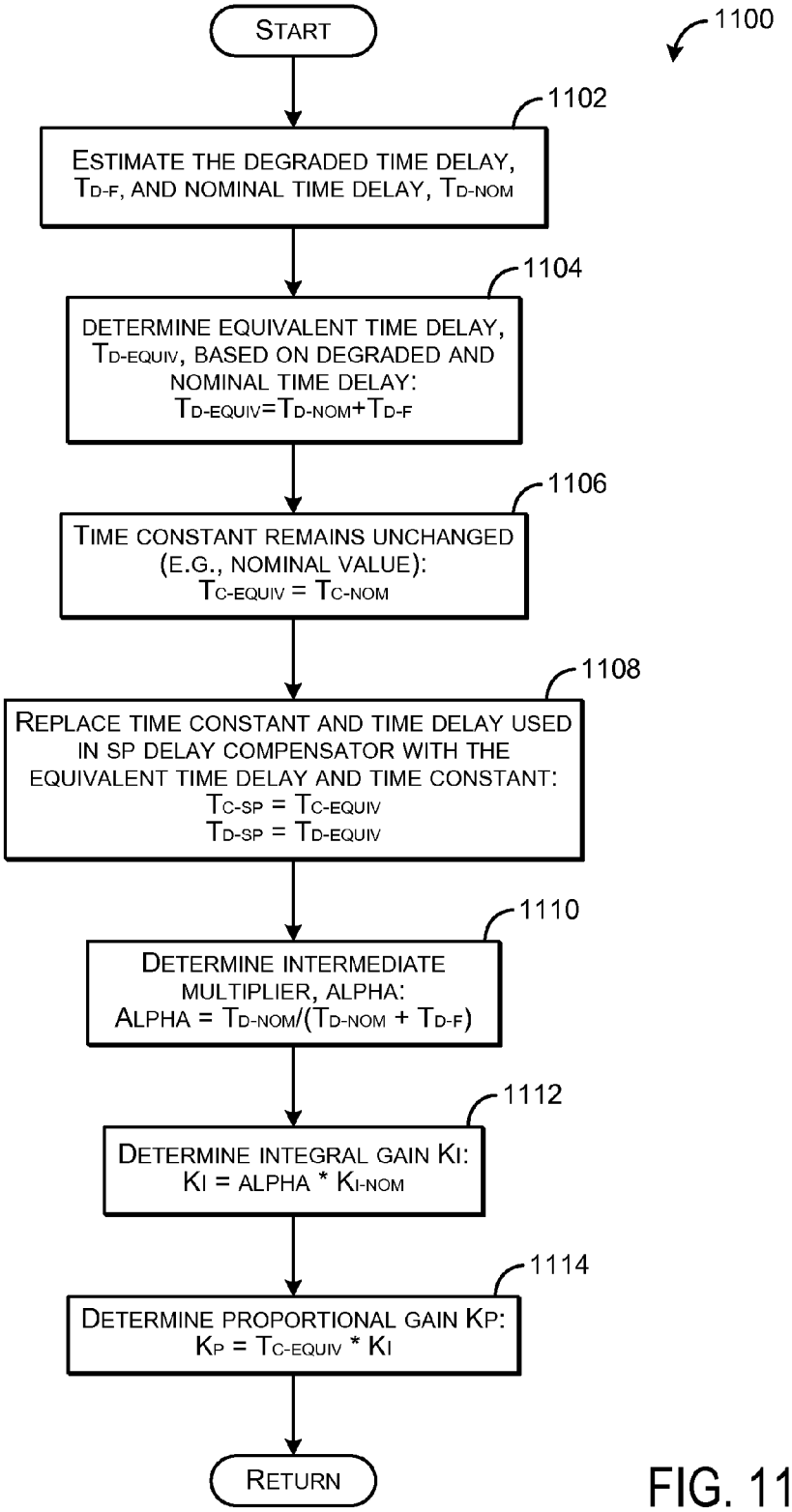
FIG. 11 is a flow chart illustrating a method for determining adjusted parameters of the anticipatory controller of the exhaust gas sensor based on delay degradation behavior.

The following description relates to systems and methods for adjusting an anticipatory controller of an exhaust gas sensor coupled in an engine exhaust, such as the exhaust gas sensor depicted in FIG. 1. Specifically, one or more parameters of the anticipatory controller may be adjusted responsive to a type of oxygen sensor degradation. Six types of degradation behavior of an exhaust gas sensor (e.g., exhaust oxygen sensor) are presented at FIGS. 2-7. The six types of degradation behavior may be grouped into two groups: filter type degradation and delay time degradation. A filter type degradation may be indicated by a degraded time constant of the response of the sensor while a delay type degradation may be indicated by a degraded time delay of the response of the sensor. The parameters of the anticipatory controller may be adjusted based on the magnitude and type of degradation, thereby altering the output of the exhaust gas sensor. FIG. 9 presents a method for adjusting parameters of the anticipatory controller of the exhaust gas sensor, based on a type and magnitude of degradation, and subsequently adjusting fuel injection of the engine. FIGS. 10 and 11 show methods for determining the adjusted anticipatory controller parameters based on the degradation behavior. In this way, the anticipatory controller may be adapted based on the type and magnitude of the degradation behavior to increase performance of the air-fuel control system.

FIG. 1 is a schematic diagram showing one cylinder of multi-cylinder engine 10, which may be included in a propulsion system of a vehicle in which an exhaust gas sensor 126 may be utilized to determine an air-fuel ratio of exhaust gas produced by engine 10. The air-fuel ratio (along with other operating parameters) may be used for feedback control of engine 10 in various modes of operation. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. A throttle 62 including a throttle plate 64 may be provided between the intake manifold 44 and the intake passage 42 for varying the flow rate and/or pressure of intake air provided to the engine cylinders. Adjusting a position of the throttle plate 64 may increase or decrease the opening of the throttle 62, thereby changing mass air flow, or the flow rate of intake air entering the engine cylinders. For example, by increasing the opening of the throttle 62, mass air flow may increase. Conversely, by decreasing the opening of the throttle 62, mass air flow may decrease. In this way, adjusting the throttle 62 may adjust the amount of air entering the combustion chamber 30 for combustion. For example, by increase mass air flow, torque output of the engine may increase.

Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves. In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Exhaust gas sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a NOx, HC, or CO sensor. In some embodiments, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Emission control device 70 may be a three way catalyst (TWC), NOx trap, various other emission control devices, or combinations thereof. In some embodiments, emission control device 70 may be a first one of a plurality of emission control devices positioned in the exhaust system. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Furthermore, at least some of the above described signals may be used in various exhaust gas sensor degradation determination methods, described in further detail below. For example, the inverse of the engine speed may be used to determine delays associated with the injection-intake-compression-expansion-exhaust cycle. As another example, the inverse of the velocity (or the inverse of the MAF signal) may be used to determine a delay associated with travel of the exhaust gas from the exhaust valve 54 to exhaust gas sensor 126. The above described examples along with other use of engine sensor signals may be used to determine the time delay between a change in the commanded air-fuel ratio and the exhaust gas sensor response rate.

In some embodiments, exhaust gas sensor degradation determination and calibration may be performed in a dedicated controller 140. Dedicated controller 140 may include processing resources 142 to handle signal-processing associated with production, calibration, and validation of the degradation determination of exhaust gas sensor 126. In particular, a sample buffer (e.g., generating approximately 100 samples per second per engine bank) utilized to record the response rate of the exhaust gas sensor may be too large for the processing resources of a powertrain control module (PCM) of the vehicle. Accordingly, dedicated controller 140 may be operatively coupled with controller 12 to perform the exhaust gas sensor degradation determination. Note that dedicated controller 140 may receive engine parameter signals from controller 12 and may send engine control signals and degradation determination information among other communications to controller 12.

The exhaust gas sensor 126 may comprise an anticipatory controller. In one example, the anticipatory controller may include a PI controller and a delay compensator, such as a Smith Predictor (e.g., SP delay compensator). The PI controller may comprise a proportional gain, $K_P$, and an integral gain, $K_I$. The Smith Predictor may be used for delay compensation and may include a time constant, $T_{C\text{-}SP}$, and time delay, $T_{D\text{-}SP}$. As such, the proportional gain, integral gain, controller time constant, and controller time delay may be parameters of the anticipatory controller of the exhaust gas sensor. Adjusting these parameters may alter the output of the exhaust gas sensor 126. For example, adjusting the above parameters may change the response rate of air-fuel ratio readings generated by the exhaust gas sensor 126. In response to degradation of the exhaust gas sensor, the controller parameters listed above may be adjusted to compensate for the degradation and increase the accuracy of air-fuel ratio readings, thereby increasing engine control and performance. The dedicated controller 140 may be communicably coupled to the anticipatory controller. As such, the dedicated controller 140 and/or controller 12 may adjust the parameters of the anticipatory controller based on the type of degradation determined using any of the available diagnostic methods, as described below. In one example, the exhaust gas sensor controller parameters may be adjusted based on the magnitude and type of degradation. Six types of degradation behaviors are discussed below with reference to FIGS. 2-7. Further details on adjusting the gains, time constant, and time delay of the exhaust gas sensor controller are presented below with reference to FIGS. 9-11.

Note storage medium read-only memory 106 and/or processing resources 142 can be programmed with computer readable data representing instructions executable by processor 102 and/or dedicated controller 140 for performing the methods described below as well as other variants.

As discussed above, exhaust gas sensor degradation may be determined based on any one, or in some examples each, of six discrete behaviors indicated by delays in the response rate of air-fuel ratio readings generated by an exhaust gas sensor during rich-to-lean transitions and/or lean-to-rich transitions. FIGS. 2-7 each show a graph indicating one of the six discrete types of exhaust gas sensor degradation behaviors. The graphs plot air-fuel ratio (lambda) versus time (in seconds). In each graph, the dotted line indicates a commanded lambda signal that may be sent to engine components (e.g., fuel injectors, cylinder valves, throttle, spark plug, etc.) to generate an air-fuel ratio that progresses through a cycle comprising one or more lean-to-rich transitions and one or more rich-to-lean transitions. In the depicted figures, the engine is entering into and exiting out of a deceleration fuel shut-off (e.g., DFSO). In each graph, the dashed line indicates an expected lambda response time of an exhaust gas sensor. In each graph, the solid line indicates a degraded lambda signal that would be produced by a degraded exhaust gas sensor in response to the commanded lambda signal. In each of the graphs, the double arrow lines indicate where the given degradation behavior type differs from the expected lambda signal.

The system of FIG. 1 may provide for a system for a vehicle including an engine including a fuel injection system and an exhaust gas sensor coupled in an exhaust gas system of the engine, the exhaust gas sensor having an anticipatory controller. The system may further include a controller including instructions executable to adjust one or more parameters of the anticipatory controller responsive to degradation of the exhaust gas sensor, wherein an amount of adjusting is based on a magnitude and type of degradation behavior of the exhaust gas sensor. Further, an amount of fuel and/or a timing of the fuel injection system may be adjusted based on exhaust oxygen feedback from the anticipatory controller.

FIG. 2 shows a graph indicating a first type of degradation behavior that may be exhibited by a degraded exhaust gas sensor. This first type of degradation behavior is a symmetric filter type that includes slow exhaust gas sensor response to the commanded lambda signal for both rich-to-lean and lean-to-rich modulation. In other words, the degraded lambda signal may start to transition from rich-to-lean and lean-to-rich at the expected times but the response rate may be lower than the expected response rate, which results in reduced lean and rich peak times.

FIG. 3 shows a graph indicating a second type of degradation behavior that may be exhibited by a degraded exhaust gas sensor. The second type of degradation behavior is an asymmetric rich-to-lean filter type that includes slow exhaust gas sensor response to the commanded lambda signal for a transition from rich-to-lean air-fuel ratio. This behavior type may start the transition from rich-to-lean at the expected time but the response rate may be lower than the expected response rate, which may result in a reduced lean peak time. This type of behavior may be considered asymmetric because the response of the exhaust gas sensor is slow (or lower than expected) during the transition from rich-to-lean.

FIG. 4 shows a graph indicating a third type of degradation behavior that may be exhibited by a degraded exhaust gas sensor. The third type of behavior is an asymmetric lean-to-rich filter type that includes slow exhaust gas sensor response to the commanded lambda signal for a transition from lean-to-rich air-fuel ratio. This behavior type may start the transition from lean-to-rich at the expected time but the response rate may be lower than the expected response rate, which may result in a reduced rich peak time. This type of behavior may be considered asymmetric because the response of the exhaust gas sensor is only slow (or lower than expected) during the transition from lean-to-rich.

FIG. 5 shows a graph indicating a fourth type of degradation behavior that may be exhibited by a degraded exhaust gas sensor. This fourth type of degradation behavior is a symmetric delay type that includes a delayed response to the commanded lambda signal for both rich-to-lean and lean-to-rich modulation. In other words, the degraded lambda signal may start to transition from rich-to-lean and lean-to-rich at times that are delayed from the expected times, but the respective transition may occur at the expected response rate, which results in shifted lean and rich peak times.

FIG. 6 shows a graph indicating a fifth type of degradation behavior that may be exhibited by a degraded exhaust gas sensor. This fifth type of degradation behavior is an asymmetric rich-to-lean delay type that includes a delayed response to the commanded lambda signal from the rich-to-lean air-fuel ratio. In other words, the degraded lambda signal may start to transition from rich-to-lean at a time that is delayed from the expected time, but the transition may occur at the expected response rate, which results in shifted and/or reduced lean peak times. This type of behavior may be considered asymmetric because the response of the exhaust gas sensor is only delayed from the expected start time during a transition from rich-to-lean.

FIG. 7 shows a graph indicating a sixth type of degradation behavior that may be exhibited by a degraded exhaust gas sensor. This sixth type of behavior is an asymmetric lean-to-rich delay type that includes a delayed response to the commanded lambda signal from the lean-to-rich air-fuel ratio. In other words, the degraded lambda signal may start to transition from lean-to-rich at a time that is delayed from the expected time, but the transition may occur at the expected response rate, which results in shifted and/or reduced rich peak times. This type of behavior may be considered asymmetric because the response of the exhaust gas sensor is only delayed from the expected start time during a transition from lean-to-rich.

The six degradation behaviors of the exhaust gas sensor described above may be divided into two groups. The first group includes the filter type degradation wherein the response rate of the air-fuel ratio reading decreases (e.g., response lag increases). As such, the time constant of the response may change. The second group includes the delay type degradation wherein the response time of the air-fuel ratio reading is delayed. As such, the time delay of the air-fuel ratio response may increase from the expected response.

A filter type degradation and a delay type degradation affect the dynamic control system of the exhaust gas sensor differently. Specifically, any one of the filter type degradation behaviors may cause the dynamic system to increase from a first order system to a second order system while any one of the delay time degradation behaviors may maintain the system as a first order system with a delay. If a filter type degradation is detected, a mapping approach may be used to transform the second order system into a first order system. New controller time constant, time delay, and gains may then be determined based on the degraded time constant. If a delay type degradation is detected, a new controller time delay and gains may be determined based on the degraded time delay. Further details on adjusting controller parameters of the exhaust gas sensor based on the type and magnitude of sensor degradation are described further below with reference to FIGS. 9-11.

Figure 8:
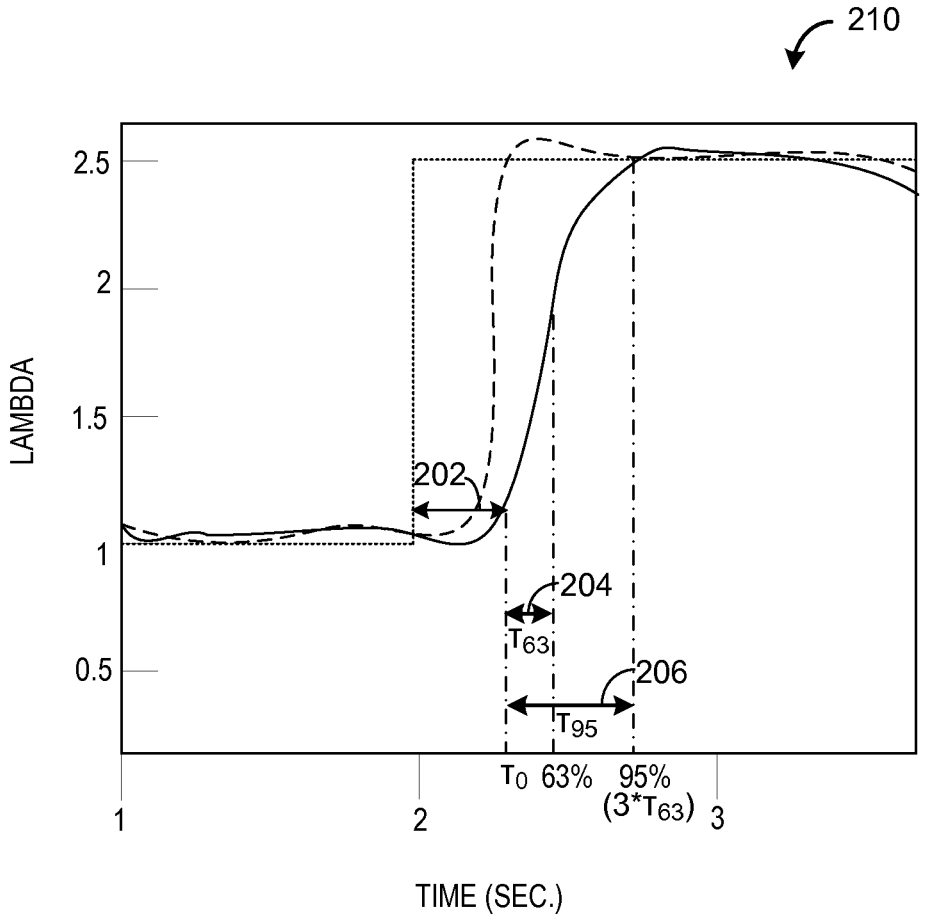
FIG. 8 shows a graph of an example degraded exhaust gas sensor response to a commanded entry into DFSO.

Various methods may be used for diagnosing degraded behavior of the exhaust gas sensor. In one example, degradation may be indicated based on a time delay and line length of each sample of a set of exhaust gas sensor response collected during a commanded change in air-fuel ratio. FIG. 8 illustrates an example of determining a time delay and line length from an exhaust gas sensor response to a commanded entry into DFSO. Specifically, FIG. 8 shows a graph 210 illustrating a commanded lambda, expected lambda, and degraded lambda, similar to the lambdas described with respect to FIGS. 2-7. FIG. 8 illustrates a rich-to-lean and/or symmetric delay degradation wherein the time delay to respond to the commanded air-fuel ratio change is delayed. The arrow 202 illustrates the time delay, which is the time duration from the commanded change in lambda to a time ($\tau_0$) when a threshold change in the measured lambda is observed. The threshold change in lambda may be a small change that indicates the response to the commanded change has started, e.g., 5%, 10%, 20%, etc. The arrow 204 indicates the time constant ($\tau_{63}$) for the response, which in a first order system is the time from $\tau_0$ to when 63% of the steady state response is achieved. The arrow 206 indicates the time duration from $\tau_0$ to when 95% of the desired response is achieved, otherwise referred to as a threshold response time ($\tau_{95}$). In a first order system, the threshold response time ($\tau_{95}$) is approximately equal to three time constants ($3*\tau_{63}$).

From these parameters, various details regarding the exhaust gas sensor response can be determined. First, the time delay, indicated by arrow 202, may be compared to an expected time delay to determine if the sensor is exhibiting a delay degradation behavior. Second, the time constant, indicated by the arrow 204, may be used to predict a $\tau_{95}$. Finally, a line length, indicated by the arrow 206, may be determined based on the change in lambda over the duration of the response, starting at $\tau_0$. The line length is the sensor signal length, and can be used to determine if a response degradation (e.g., filter type degradation) is present. The line length may be determined based on the equation:

$$\text{line length}=\Sigma\sqrt{\Delta t^2+\Delta\lambda^2}$$

If the determined line length is greater than an expected line length, the exhaust gas sensor may be exhibiting a filter type degradation. A time constant and/or time delay of the degraded exhaust gas sensor response may be used by the controller to adjust parameters of the exhaust gas sensor controller. Methods for adjusting the exhaust gas sensor controller parameters based on the degradation behavior are presented below at FIGS. 9-11.

In another example, exhaust gas sensor degradation may be indicated by monitoring characteristics of a distribution of extreme values from multiple sets of successive lambda samples in steady state operating conditions. In one example, the characteristics may be a mode and central peak of a generalized extreme value (GEV) distribution of the extreme lambda differentials collected during steady state operating conditions. Asymmetric delay or asymmetric slow response degradation may be determined based on the magnitude of the central peak and/or the magnitude of the mode. Further classification, for example symmetric delay or symmetric slow response, may be based on a determined sensor delay or a determined sensor time constant. Specifically, if the determined sensor time delay is greater than a nominal time delay, a sensor symmetric delay is indicated (e.g., indicates delay type degradation). The nominal sensor time delay is the expected delay in sensor response to a commanded air-fuel ratio change based on the delay from when the fuel is injected, combusted, and the exhaust travels from the combustion chamber to the exhaust sensor. The determined time delay may be when the sensor actually outputs a signal indicating the changed air-fuel ratio. Similarly, if the determined sensor time constant is greater than a nominal time constant, a sensor symmetric response degradation behavior is indicated (e.g., indicates filter type degradation). The nominal time constant may be the time constant indicating how quickly the sensor responds to a commanded change in lambda, and may be determined off-line based on non-degraded sensor function. As discussed above, the determined time constant and/or time delay of the degraded exhaust gas sensor response may be used by the controller to adjust parameters of the exhaust gas sensor controller.

In yet another example, exhaust gas sensor degradation may be indicated by parameters estimated from two operation models, a rich combustion model and a lean combustion model. Commanded air-fuel ratio and the air-fuel ratio indicated by the exhaust gas sensor may be compared with the assumption that the combustion that generated the air-fuel ratio was rich (e.g., inputting the commanded lambda into the rich model) and also compared assuming that the combustion event was lean (e.g., inputting the commanded lambda into the lean model). For each model, a set of parameters may be estimated that best fits the commanded lambda values with the measured lambda values. The model parameters may include a time constant, time delay, and static gain of the model. The estimated parameters from each model may be compared to each other, and the type of sensor degradation (e.g., filter vs. delay) may be indicated based on differences between the estimated parameters.

One or more of the above methods for diagnosing degradation of the exhaust gas sensor may be used in the routines described further below (FIGS. 9-11). These methods may be used to determine if the exhaust gas sensor is degraded and if so, what type of degradation has occurred (e.g., filter or delay type). Further, these methods may be used to determine the magnitude of the degradation. Specifically, the above methods may determine a degraded time constant and/or time delay.

In some embodiments, exhaust gas sensor degradation may be simulated and induced in order to calibrate the exhaust gas sensor. For example, a fault inducer may act externally on the exhaust gas sensor system. In one example, the fault inducer may induce a filter type fault, thereby simulating a filter type degradation behavior. This may transform the anticipatory controller system of the exhaust gas sensor into a second order system. The magnitude of the induced fault or simulated degradation may then be determined using a system identification method. Alternatively, one of the other methods described above may be used to determine the magnitude of the degradation from the air-fuel ratio response of the exhaust gas sensor.

Using the system identification method, a nominal system operation of the anticipatory controller may be described by a frequency domain plant model, $G_1(s)$. The filter fault induced on the system may be given by $G_2(s)$. Thus, the faulted or degraded anticipatory controller system of the exhaust gas sensor may be described by the following equation:

$$G_1(s) * G_2(s) = \frac{e^{-T_d s}}{(\tau_1 s + 1)(\tau_2 s + 1)}$$

In this second order continuous time model, $T_d$ is a time delay, $\tau_1$ is the time constant of the nominal system, and $\tau_2$ is the time constant of the faulted or degraded system. As $G_1(s)*G_2(s) \neq G_1(z)*G_2(z)$, $G_1(z)$ and $G_2(z)$ being the respective discrete time domain model of the nominal system and the induced fault, the second order continuous time model may be linked to a first order discrete time model. By rearranging the equation above we obtain the following:

$$\frac{\tau_1}{\tau_1 s + 1} - \frac{\tau_2}{\tau_2 s + 1} = \frac{\tau_1(\tau_2 s + 1) - \tau_2(\tau_1 s + 1)}{(\tau_1 s + 1)(\tau_2 s + 1)} = \frac{\tau_1 - \tau_2}{(\tau_1 s + 1)(\tau_2 s + 1)}$$

-continued $$\frac{1}{(\tau_1 s + 1)(\tau_2 s + 1)} = \frac{1}{(\tau_1 - \tau_2)}\left[\frac{\tau_1}{(\tau_2 s + 1)} - \frac{\tau_2}{(\tau_1 s + 1)}\right]$$

The equivalent Z-transform of the first order system:

$$\frac{1}{(s + a)}$$

is:

$$\frac{z}{z - e^{-aT_s}}$$

where a is the pole and $T_s$ is the sampling time. Then, $$\frac{1}{(\tau_1 s + 1)(\tau_2 s + 1)} = \frac{1}{(\tau_1 - \tau_2)}\left[\frac{\tau_1}{(\tau_2 s + 1)} - \frac{\tau_2}{(\tau_1 s + 1)}\right]$$

becomes:

$$\frac{\tau_1}{\tau_1 - \tau_2}\left[\frac{1}{\tau_1}\frac{z}{z - e^{-T_s/\tau_1}}\right] - \frac{\tau_2}{\tau_1 - \tau_2}\left[\frac{1}{\tau_2}\frac{z}{z - e^{-T_s/\tau_2}}\right]$$

Then, rearranging, we obtain the following equation:

$$\frac{1}{(\tau_1 - \tau_2)}\left[\frac{z}{z - e^{-T_s/\tau_1}} - \frac{z}{z - e^{-T_2/\tau_2}}\right] = \frac{(e^{-T_s/\tau_1} - e^{-T_s/\tau_2})}{\tau_1 - \tau_2}\left[\frac{z}{(z - e^{-T_s/\tau_1})(z - e^{-T_s/\tau_2})}\right] = a_1\left[\frac{z}{(z - z_1)(z - z_2)}\right] = a_1\left[\frac{z}{z^2 + b_1 z + b_2}\right]$$

Where, $$a_1 = \frac{(e^{-T_s/\tau_1} - e^{-T_s/\tau_2})}{\tau_1 - \tau_2}$$

$$b_1 = (-e^{-T_s/\tau_1} - e^{-T_s/\tau_2})$$

$$b_2 = e^{-\frac{T_s}{\tau_1} - \frac{T_s}{\tau_2}}$$

Now, to find $\tau_1$ and $\tau_2$ using the coefficients $a_1$, $b_1$, and $b_2$, the second order equation of the denominator is solved for the poles. Then each of the poles are mapped to the frequency domain poles:

$$\Delta = b_1^2 - 4b_2$$

$$z_1 = \frac{-b_1 - \sqrt{\Delta}}{2}$$

$$z_2 = \frac{-b_1 + \sqrt{\Delta}}{2}$$

The fault inducer yields an over-damped second order system due to the presence of both real positive time constants of the nominal system and the faulted system. This guarantees that Δ cannot be negative. Finally, $\tau_1$ and $\tau_2$ are calculated using $z_1$ and $z_2$:

$$\tau_1 = \frac{-T_s}{\log(z_1)}$$

$$\tau_2 = \frac{-T_s}{\log(z_2)}$$

To estimate the coefficients $a_1$, $b_1$, and $b_2$, the difference equation may be written in the following vector product:

$$y(k) = [\,u(k-1-d) \quad -y(k-1) \quad -y(k-2)\,]\begin{bmatrix} a_1 \\ b_1 \\ b_2 \end{bmatrix}$$

Then, this equation may be written in the following matrix form:

$$Y = AX$$

$$Y = \begin{bmatrix} y(2+d) \\ \vdots \\ y(n) \end{bmatrix}$$

$$A = \begin{bmatrix} u(1) & -y(1+d) & -y(d) \\ \vdots & \vdots & \vdots \\ u(n-1-d) & -y(n-1) & -y(n-2) \end{bmatrix}$$

$$X = \begin{bmatrix} a_1 \\ b_1 \\ b_2 \end{bmatrix}$$

Here, A is the information matrix of the system, built using the input and output data, X is the vector of unknown coefficients, and Y is the vector of the last (n−1−d) values of the output, where d is the delay parameter (positive integer). Using algebra, X may be obtained by pseudo-inverting the information matrix A:

$$X=M^{-1}A^TY$$

Where, $$M=A^TA$$

A recursive implementation may be possible to calculate X; however, since the matrix M is 3x#, the inverse may be obtained using the following equations:

$$M^{-1} = \begin{bmatrix} a_{11} & a_{12} & a_{13} \\ a_{21} & a_{22} & a_{23} \\ a_{31} & a_{32} & a_{33} \end{bmatrix}^{-1} =$$

$$\frac{1}{D} * \begin{bmatrix} a_{33}a_{22} - a_{32}a_{23} & -(a_{33}a_{12} - a_{32}a_{13}) & a_{23}a_{12} - a_{22}a_{13} \\ -(a_{33}a_{21} - a_{31}a_{23}) & a_{33}a_{11} - a_{31}a_{13} & -(a_{23}a_{11} - a_{21}a_{13}) \\ a_{32}a_{21} - a_{31}a_{22} & -(a_{32}a_{11} - a_{31}a_{12}) & a_{22}a_{11} - a_{21}a_{12} \end{bmatrix}$$

Where, $$D=a_{11}(a_{33}a_{22}-a_{32}a_{23})-a_{21}(a_{33}a_{12}-a_{32}a_{13})+a_{31}(a_{23}a_{12}-a_{22}a_{13})$$

Recursive implementation of the algorithm may have some advantages regarding on-line implementation, especially in the realistic cases of insufficient input excitation and measurement noise, and possible singularity of the matrix M. The recursive identification approach is based on application of a Kalman filter for estimating the state of the virtual MISO system:

$$X(k+1)=X(k)$$

$$\hat{y}(k)=\theta^T(k)X(k)+e(k)$$

Where X(k) and θ(k) are the parameter and input/state regressor vectors, defined as:

$$X = \begin{bmatrix} a_1 \\ b_1 \\ b_2 \end{bmatrix}$$

$$\theta^T(k) = [\,u(k-1-d) \quad -y(k-1) \quad -y(k-2)\,]$$

The real time learning estimation of the unknown model parameters is performed by the Kalman filter:

$$X(k)=X(k)+C(k)\Theta(k)(y(k)-\Theta^T(k)X(k))$$

$$C(k)=C(k-1)-C(k-1)\Theta(k)(\lambda+\Theta^T(k)C(k-1)\Theta(k))^{-1}\Theta^T(k)C(k-1)$$

Where C(k) is the recursively calculated inverse covariance matrix and $0<\lambda<1$ is a forgetting factor accounting for nonstationarity of the model parameters.

In this way, the system identification method may be used to determine the nominal time constant and the degraded (or faulted) time constant. These values may then be used to determine the parameters of the anticipatory controller of the exhaust gas sensor. Methods for determining these parameters are described below at FIGS. 9-11.

After determining the exhaust gas sensor is degraded, one of the methods discussed above may be used to determine the time constant and/or time delay of the degraded response. These parameters may be referred to herein as the degraded (e.g., faulted) time constant, $T_{C\text{-}F}$, and the degraded time delay, $T_{D\text{-}f}$. The degraded time constant and time delay may then be used, along with the nominal time constant, $T_{C\text{-}nom}$, and nominal time delay, $T_{D\text{-}nom}$, to determine adjusted parameters of the anticipatory controller. As discussed above, the adjusted parameters of the anticipatory controller may include a proportional gain, $K_P$, an integral gain, $K_I$, a controller time constant, $T_{C\text{-}SP}$, and controller time delay, $T_{D\text{-}SP}$. The adjusted controller parameters may be further based on the nominal system parameters (e.g., parameters pre-set in the anticipatory controller). By adjusting the controller gains and time constant and time delay of the SP delay compensator, accuracy of the air-fuel ratio command tracking may increase and the stability of the anticipatory controller may increase. As such, after applying the adjusted controller parameters within the exhaust gas sensor system, the engine controller may adjust fuel injection timing and/or amount based on the air-fuel ratio output of the exhaust gas sensor. In some embodiments, if the exhaust gas sensor degradation exceeds a threshold, the engine controller may additionally alert the vehicle operator.

In this way, fuel injection may be adjusted responsive to exhaust oxygen feedback from an anticipatory controller of an exhaust gas sensor. Further, one or more parameters of the anticipatory controller may be adjusted responsive to a type of oxygen sensor degradation. The type of oxygen sensor degradation may include a filter degradation or a delay degradation. The one or more parameters of the anticipatory controller may include a proportional gain, an integral gain, a controller time constant, and a controller time delay. In one example, the filter degradation is indicated by a degraded time constant being greater than an expected time constant. In another example, the filter degradation may be indicated by the degraded time constant in addition to a nominal time constant. In yet another example, the delay degradation is indicated by a degraded time delay being greater than an expected time delay. The degraded time constant may be the time constant of the degraded response of the exhaust gas sensor in the presence of a filter type degradation. Similarly, the degraded time delay may be the time delay of the degraded response of the exhaust gas sensor in the presence of a delay type degradation.

As discussed above, the anticipatory controller parameters may be adjusted based on the type of oxygen sensor degradation (e.g., filter vs. delay degradation). For example, the integral gain may be adjusted responsive to both the delay degradation and the filter degradation. Adjusting the integral gain may be based on one or more of the degraded time delay and the degraded time constant. The proportional gain may be adjusted by a first amount responsive to the delay degradation and adjusted by a second, different, amount responsive to the filter degradation. The adjusting the proportional gain by the first amount may be based on the degraded time delay while adjusting the proportional gain by the second amount may be based on the degraded time constant. The controller time constant may be adjusted responsive to the filter degradation and not adjusted responsive to the delay degradation. Adjusting the controller time constant may be based on the degraded time constant. Finally, the controller time delay may be adjusted by a first amount responsive to the filter degradation and adjusted by a second amount responsive to the delay degradation. Adjusting the controller time delay by the first amount may be based on the degraded time constant while adjusting the controller time delay by the second amount may be based on the degraded time delay. In some embodiments, a filter degradation may be induced with a fault inducer, the fault inducer acting externally on the anticipatory controller.

Turning now to FIG. 9, an example method 900 for adjusting parameters of an anticipatory controller of an exhaust gas sensor, based on a type and magnitude of degradation is depicted. Method 900 may be carried out by a control system of a vehicle, such as controller 12 and/or dedicated controller 140, to monitor an air-fuel ratio response via a sensor such as exhaust gas sensor 126.

Method 900 begins at 902 by determining engine operating conditions. Engine operating conditions may be determined based on feedback from various engine sensors, and may include engine speed and load, air-fuel ratio, temperature, etc. Method 900 then proceeds to 926 to determine if it is time to induce degradation of the exhaust gas sensor. As discussed above, in some embodiments, exhaust gas sensor degradation may be induced for testing and/or calibration purposes. In one example, the degradation may be induced with a fault inducing tool, such as a fault inducer. The fault inducer may be included as part of dedicated controller 140 and/or controller 12. In this way, the fault inducer may act externally on the anticipatory controller system of the exhaust gas sensor. The controller may determine when a fault (e.g., degradation) should be induced by the fault inducer. For example, a fault may be induced after a duration of vehicle operation. Alternatively, a fault may be induced as a maintenance test during vehicle operation. In this way, the exhaust gas sensor may be calibrated by inducing different sensor degradation behaviors and adjusting parameters of the anticipatory controller.

If the controller determines it is time to induce degradation, the method continues on to 928 to induce degradation. This may include inducing degradation with the fault inducer, described above. In one example, only one type of fault or degradation behavior may be induced (e.g., one of the six behaviors presented in FIGS. 2-7). In another example, more than one type of degradation behavior may be induced at one time. In yet another example, all six types of degradation behavior may be induced to fully calibrate the exhaust gas sensor. Once inducing the fault via the fault inducer is imitated, the method continues on to 908 to determine the type of sensor degradation, described further below.

However, if it is not time to induce degradation at 926, method 300 proceeds to 904. Based on the conditions at 902, method 900 determines at 904 if exhaust gas sensor monitoring conditions are met. In one example, this may include if the engine is running and if selected conditions are met. The selected conditions may include that the input parameters are operational, for example, that the exhaust gas sensor is at a temperature whereby it is outputting functional readings. Further, the selected conditions may include that combustion is occurring in the cylinders of the engine, e.g. that the engine is not in a shut-down mode such as deceleration fuel shut-off (DFSO), or that the engine is operating in steady-state conditions.

If it is determined that the engine is not running and/or the selected conditions are not met, method 900 returns and does not monitor exhaust gas sensor function. However, if the exhaust gas sensor conditions are met at 904, the method proceeds to 906 to collect input and output data from the exhaust gas sensor. This may include collecting and storing air-fuel ratio (e.g., lambda) data detected by the sensor. The method at 906 may continue until a necessary number of samples (e.g., air-fuel ratio data) are collected for the degradation determination method at 908.

At 908, method 900 includes determining if the exhaust gas sensor is degraded, based on the collected sensor data. The method at 908 may further include determining the type of degradation or degradation behavior of the exhaust gas sensor (e.g., filter vs. delay degradation). As described above, various methods may be used to determine exhaust gas sensor degradation behavior. In one example, degradation may be indicated based on a time delay and line length of each sample of a set of exhaust gas sensor responses collected during a commanded change in air-fuel ratio. A degraded time delay and time constant, along with a line length, may be determined from the exhaust gas sensor response data and compared to expected values. For example, if the degraded time delay is greater than the expected time delay, the exhaust gas sensor may be exhibiting a delay degradation behavior (e.g., degraded time delay). If the determined line length is greater than the expected line length, the exhaust gas sensor may be exhibiting a filter degradation behavior (e.g., degraded time constant).

In another example, exhaust gas sensor degradation may be determined from characteristics of a distribution of extreme values from multiple sets of successive lambda samples during steady state operating conditions. The characteristics may be a mode and central peak of a generalized extreme value (GEV) distribution of the extreme lambda differentials collected during steady state operating conditions. The magnitude of the central peak and mode, along with a determined time constant and time delay, may indicate the type of degradation behavior, along with the magnitude of the degradation.

In yet another example, exhaust gas sensor degradation may be indicated based on a difference between a first set of estimated parameters of a rich combustion model and a second set of estimated parameters of a lean combustion model. The estimated parameters may include the time constant, time delay, and static gain of both the commanded lambda (air-fuel ratio) and the determined lambda (e.g., determined from exhaust gas sensor output). The type of exhaust gas sensor degradation (e.g., filter vs. delay) may be indicated based on differences between the estimated parameters. It should be noted that an alternative method to the above methods may be used to determine exhaust gas sensor degradation.

If exhaust gas sensor degradation is induced using the fault inducer, the type of degradation or fault induced may already be known. Thus, at 908 the type of degradation behavior induced by the fault inducer may be stored in the controller and used at 910 and/or 912.

After one or more of the above methods are employed, the method continues on to 910 to determine if filter degradation (e.g., time constant degradation) is detected. If filter degradation is not detected, the method continues on to 912 to determine if delay degradation is detected (e.g., time delay degradation). If delay degradation is also not detected, the method determines at 914 that the exhaust gas sensor is not degraded. The parameters of the anticipatory controller are maintained and the method returns to continue monitoring the exhaust gas sensor.

Returning to 910, if a filter type degradation is indicated, the method continues on to 916 to approximate the system by a first order plant with delay model (e.g., FOPD). This may include applying a half rule approximation to the nominal time constant, nominal time delay, and degraded time constant to determine equivalent first order time constant and time delay. The method may further include determining adjusted controller gains. Further details on the method at 916 are presented at FIG. 10.

Alternatively, if a delay type degradation is indicated at 912, the method continues on to 918 to determine an equivalent or new time delay in the presence of the degradation. The method further includes determining adjusted anticipatory controller parameters, including controller gains and controller time constant and time delay (used in delay compensator). Further details on the method at 918 are presented at FIG. 11.

From 916 and 918, method 900 continues on to 920 to apply the newly determined anticipatory controller parameters. The exhaust gas sensor may then use these parameters in the anticipatory controller to determine the measured air-fuel ratio. At 922, the method includes determining the air-fuel ratio from the exhaust gas sensor and adjusting fuel injection and/or timing based on the determined air-fuel ratio. For example, this may include increasing the amount of fuel injected by the fuel injectors if the air-fuel ratio is above a threshold value. In another example, this may include decreasing the amount of fuel injected by the fuel injectors if the air-fuel ratio is below the threshold value. In some embodiments, if the degradation of the exhaust gas sensor exceeds a threshold, method 300 may include notifying the vehicle operator at 924. The threshold may include a degraded time constant and/or time delay over a threshold value. Notifying the vehicle operator at 924 may include sending a notification or maintenance request for the exhaust gas sensor.

FIG. 10 is a flow chart illustrating a method 1000 for determining adjusted parameters of the anticipatory controller of the exhaust gas sensor based on filter degradation behavior. Method 1000 may be carried out by controller 12 and/or dedicated controller 140, and may be executed during 916 of method 900 described above. At 1002, method 1000 includes estimating the degraded time constant, $T_{C\text{-}F}$, and the nominal time constant, $T_{C\text{-}nom}$. As discussed above, the nominal time constant may be the time constant indicating how quickly the sensor responds to a commanded change in lambda, and may be determined off-line based on non-degraded sensor function. The degraded time constant may be estimated using any of the methods for determining degradation at 908 in method 900, as discussed above. If the filter degradation is induced by the fault inducer, a system identification method, as discussed above, may be used to determine the degraded and nominal time constants.

After determining the degraded time constant $T_{C\text{-}F}$ and the nominal time constant $T_{C\text{-}nom}$, method 1000 proceeds to 1004 to approximate the second order system by a first order model (e.g., FOPD). The method at 1004 may include applying a half rule approximation to the degraded system. The half rule approximation includes distributing the smaller time constant (between the nominal and degraded time constants) evenly between the larger time constant and the nominal time delay. This may be done using the following equations:

$$T_{C\text{-}Equiv} = \mathrm{MAX}(T_{C\text{-}F}, T_{C\text{-}nom}) + \frac{1}{2} * \mathrm{MIN}(T_{C\text{-}F}, T_{C\text{-}nom})$$

$$T_{D\text{-}Equiv} = T_{D\text{-}nom} + \frac{1}{2} * \mathrm{MIN}(T_{C\text{-}F}, T_{C\text{-}nom})$$

If the degraded time constant $T_{C\text{-}F}$ is smaller than the nominal time constant $T_{C\text{-}nom}$ the equations become:

$$T_{C\text{-}Equiv} = T_{C\text{-}nom} + \frac{1}{2} T_{C\text{-}F}$$

$$T_{D\text{-}Equiv} = T_{D\text{-}nom} + \frac{1}{2} T_{C\text{-}F}$$

At 1006, the controller may replace the controller time constant, $T_{C\text{-}SP}$, and the controller time delay, $T_{D\text{-}SP}$, used in the SP delay compensator (in the anticipatory controller) with the determined equivalent time constant, $T_{C\text{-}Equiv}$, and the equivalent time delay, $T_{D\text{-}Equiv}$.

At 1008, the controller determines an intermediate multiplier, alpha, of the anticipatory controller. The intermediate multiplier is defined by the following equation:

$$\mathrm{Alpha} = \frac{T_{D\text{-}nom}}{(T_{D\text{-}Equiv})}$$

The intermediate multiplier alpha may be used to determine the integral gain $K_I$ of the anticipatory controller at 1010. The integral gain $K_I$ is determined from the following equation:

$$K_I = \mathrm{alpha} * K_{I\text{-}nom}$$

Where $K_{I\text{-}nom}$ is the nominal integral gain of the anticipatory controller. Since alpha=1 for a filter degradation, $K_I$ is maintained at the nominal value.

Finally, at 1012, the controller determines the proportional gain, $K_P$, based on the integral gain $K_I$ and the equivalent time constant $T_{C\text{-}Equiv}$. The proportional gain $K_P$ is determined from the following equation:

$$K_P = T_{C\text{-}Equiv} * K_I$$

As the magnitude of the filter degradation increases (e.g., as the degraded time constant increases), the equivalent time constant $T_{C\text{-}Equiv}$ increases, thereby increasing $K_P$. After determining the new anticipatory controller parameters, the method returns to 916 of method 900 and continues on to 920 to apply the new controller parameters.

In this way, the anticipatory controller gains, time constant, and time delay may be adjusted based on the magnitude and type of degradation behavior. Specifically, for a filter type degradation (e.g., time constant degradation), the proportional gain, the integral gain, and controller time constant and time delay ($T_{C\text{-}SP}$ and $T_{D\text{-}SP}$) may be adjusted based on the degraded time constant.

FIG. 11 is a flow chart illustrating a method 1100 for determining adjusted parameters of the anticipatory controller of the exhaust gas sensor based on delay degradation behavior. Method 1000 may be carried out by controller 12 and/or dedicated controller 140, and may be executed during 918 of method 900 described above. At 1102, method 1100 includes estimating the degraded time delay, $T_{D\text{-}F}$, and the nominal time delay, $T_{D\text{-}nom}$. As discussed above, the nominal time delay is the expected delay in exhaust gas sensor response to a commanded air-fuel ratio change based on the delay from when the fuel is injected, combusted, and the exhaust travels from the combustion chamber to the exhaust sensor. The degraded time delay $T_{D\text{-}F}$ may be estimated using any of the methods for determining degradation at 908 in method 900, as discussed above.

After determining the degraded time delay $T_{D\text{-}F}$ and the nominal time delay $T_{D\text{-}nom}$, method 1100 proceeds to 1104 to determine the equivalent time delay, $T_{D\text{-}Equiv}$, based on the degraded time delay $T_{D\text{-}F}$ and the nominal time delay $T_{D\text{-}nom}$. The equivalent time delay $T_{D\text{-}Equiv}$ may be estimated by the following equation:

$$T_{D\text{-}Equiv}=T_{D\text{-}nom}+T_{D\text{-}F}$$

In this way, the equivalent time delay is the extra time delay (e.g., degraded time delay) after the expected time delay (e.g., nominal time delay).

The time constant may not change for a delay degradation. Thus, at 1106, the equivalent time constant $T_{C\text{-}Equiv}$ may be set to the nominal time constant $T_{C\text{-}nom}$. At 1108, the controller may replace the controller time constant, $T_{C\text{-}SP}$, and the controller time delay, $T_{D\text{-}SP}$, used in the SP delay compensator (in the anticipatory controller) with the determined equivalent time constant, $T_{C\text{-}Equiv}$, and the equivalent time delay, $T_{D\text{-}Equiv}$. For the delay degradation, the controller time constant $T_{C\text{-}SP}$ may remain unchanged.

At 1110, the controller determines the intermediate multiplier, alpha, of the anticipatory controller. The intermediate multiplier may be based on the degraded time delay and the nominal time delay. The intermediate multiplier is defined by the following equation:

$$\text{Alpha}=\frac{T_{D\text{-}nom}}{(T_{D\text{-}Nom}+T_{D\text{-}f})}$$

The intermediate multiplier alpha may then be used to determine the integral gain $K_I$ of the anticipatory controller at 1112. The integral gain $K_I$ is determined from the following equation:

$$K_I=\text{alpha}*K_{I\text{-}nom}$$

Where $K_{I\text{-}nom}$ is the nominal integral gain of the anticipatory controller. As the magnitude of the delay degradation (e.g., value of $T_{DF}$) increases, alpha may decrease. This, in turn, causes the integral gain $K_I$ to decrease. Thus, the integral gain may be reduced by a greater amount as the degraded time delay $T_{D\text{-}F}$ and magnitude of the delay degradation increases.

Finally, at 1114, the controller determines the proportional gain, $K_P$, based on the integral gain $K_I$ and the equivalent time constant $T_{C\text{-}Equiv}$. The proportional gain $K_P$ is determined from the following equation:

$$K_P=T_{C\text{-}Equiv}*K_I$$

Since the equivalent time constant $T_{C\text{-}Equiv}$ may not change for a delay type degradation, the proportional gain $K_P$ may be based on the integral gain $K_I$. Thus, as $K_I$ decreases with increasing degraded time delay $T_{D\text{-}F}$, the proportional grain $K_P$ also decreases. After determining the new anticipatory controller parameters, the method returns to 916 of method 900 and continues on to 920 to apply the new controller parameters.

In this way, the anticipatory controller gains, time constant, and time delay may be adjusted based on the magnitude and type of degradation behavior. Specifically, for a delay type degradation (e.g., time delay degradation), the proportional gain, integral gain, and controller time delay ($T_{D\text{-}SP}$) may be adjusted based on the degraded time delay while the controller time constant ($T_{C\text{-}SP}$) is maintained.

As described above, parameters of an anticipatory controller of an exhaust gas sensor may be adjusted by a first amount responsive to a delay degradation and adjusted by a second, different, amount responsive to a filter degradation. The adjusted parameters may alter a reading or exhaust oxygen feedback from the anticipatory controller. Fuel injection may then be adjusted responsive to the exhaust oxygen feedback from the anticipatory controller. Adjusting parameters of the anticipatory controller may include adjusting one or more of a proportional gain, an integral gain, a controller time constant, and a controller time delay. Adjusting parameters by the first amount responsive to the delay degradation may include adjusting the proportional gain, the integral gain, and the controller time delay based on a degraded time delay and not adjusting the controller time constant. Further, adjusting parameters by the first amount includes increasing the controller time delay and decreasing the integral gain and proportional gain by larger amounts as the degraded time delay increases. Conversely, adjusting parameters by the second amount responsive to the filter degradation may include adjusting the proportional gain, the integral gain, controller time constant, and controller time delay based on a degraded time constant. Further, adjusting parameters by the second amount may include increasing the proportional gain, controller time constant, and controller time delay by a larger amount as the degraded time constant increases.

In this way, the anticipatory controller gains, time constant, and time delay may be adapted as a function of the degraded time constant and degraded time delay. The degraded time constant value and the degraded time delay value may be the magnitude of the respective filter degradation and delay degradation. These values may be determined by various methods and compared against expected time delay and time constant values to determine the type of degradation (e.g., delay vs. filter). The controller gains and the controller time constant and time delay used for delay compensation within the anticipatory controller may then be determined and adjusted based on the magnitudes of the degraded time constant and/or degraded time delay. If the degradation behavior is a filter type degradation, the resulting second order system may be approximated by a first order system. An equivalent time constant and time delay may be estimated from the first order system and used to determine the controller gains, time constant, and time delay. The anticipatory controller parameters may be adjusted by different amounts based on whether the time constant or the time delay of the system is degraded. As such, the anticipatory controller may be adapted based on the type and magnitude of the degradation behavior. In this way, performance of the air-fuel control system may be increased.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. An engine method, comprising:

adjusting fuel injection responsive to exhaust oxygen feedback from an anticipatory controller of an exhaust gas sensor; and adjusting one or more parameters of the anticipatory controller responsive to a type of oxygen sensor degradation, wherein the type of oxygen sensor degradation includes a filter degradation or a delay degradation, the filter degradation comprising the exhaust oxygen feedback transitioning at an expected time with a response rate different than an expected response rate, and the delay degradation comprising the exhaust oxygen feedback transitioning with the expected response rate at a time different than the expected time.

2. The method of claim 1, further comprising inducing a filter degradation with a fault inducer, the fault inducer acting externally on the anticipatory controller, and wherein the type of oxygen sensor degradation includes each of the filter degradation and the delay degradation.

3. The method of claim 2, wherein the one or more parameters includes a proportional gain, an integral gain, a controller time constant, and a controller time delay.

4. The method of claim 2, wherein the filter degradation is indicated by a degraded time constant being greater than an expected time constant and the delay degradation is indicated by a degraded time delay being greater than an expected time delay.

5. The method of claim 3, further comprising adjusting the integral gain responsive to both the delay degradation and the filter degradation.

6. The method of claim 5, wherein the adjusting the integral gain is based on one or more of a degraded time delay and degraded time constant.

7. The method of claim 3, further comprising adjusting the proportional gain by a first amount responsive to the delay degradation and adjusting the proportional gain by a second, different, amount responsive to the filter degradation.

8. The method of claim 7, wherein the adjusting the proportional gain by the first amount is based on a degraded time delay and adjusting the proportional gain by the second amount is based on a degraded time constant.

9. The method of claim 3, further comprising adjusting the controller time constant responsive to the filter degradation and not adjusting the controller time constant responsive to the delay degradation.

10. The method of claim 9, wherein adjusting the controller time constant is based on a degraded time constant.

11. The method of claim 3, further comprising adjusting the controller time delay by a first amount responsive to the filter degradation and adjusting the controller time delay by a second amount responsive to the delay degradation.

12. The method of claim 11, wherein adjusting the controller time delay by the first amount is based on a degraded time constant and adjusting the controller time delay by the second amount is based on a degraded time delay.

13. An engine method, comprising:

adjusting parameters of an anticipatory controller of an exhaust gas sensor by a first amount responsive to a delay degradation and adjusting parameters of the anticipatory controller by a second, different, amount responsive to a filter degradation, the filter degradation comprising feedback from the exhaust gas sensor transitioning with a response rate different than an expected response rate, and the delay degradation comprising the feedback transitioning at a time different than an expected time; and adjusting fuel injection responsive to exhaust oxygen feedback from the anticipatory controller.

14. The method of claim 13, wherein adjusting parameters of the anticipatory controller includes adjusting one or more of a proportional gain, an integral gain, a controller time constant, and a controller time delay.

15. The method of claim 14, wherein adjusting parameters by the first amount responsive to the delay degradation includes adjusting the proportional gain, the integral gain, and the controller time delay based on a degraded time delay and not adjusting the controller time constant.

16. The method of claim 15, wherein adjusting parameters by the first amount includes increasing the controller time delay and decreasing the integral gain and proportional gain by larger amounts as the degraded time delay increases.

17. The method of claim 14, wherein adjusting parameters by the second amount responsive to the filter degradation includes adjusting the proportional gain, integral gain, controller time constant, and controller time delay based on a degraded time constant.

18. The method of claim 17, wherein adjusting parameters by the second amount includes increasing the proportional gain, controller time constant, and controller time delay by a larger amount as the degraded time constant increases.

19. A system for a vehicle, comprising:

an engine including a fuel injection system;

an exhaust gas sensor coupled in an exhaust gas system of the engine, the exhaust gas sensor having an anticipatory controller; and a controller including instructions executable to adjust one or more parameters of the anticipatory controller responsive to degradation of the exhaust gas sensor, wherein an amount of adjusting is based on a magnitude and type of degradation behavior of the exhaust gas sensor, the type of degradation behavior including a filter degradation and a delay degradation, the filter degradation comprising feedback from the exhaust gas sensor transitioning with a response rate different than an expected response rate, and the delay degradation comprising the feedback transitioning at a time different than an expected time.

20. The system of claim 19, wherein an amount of fuel and/or a timing of the fuel injection system is adjusted based on exhaust oxygen feedback from the anticipatory controller.

* * * * *